United States Patent [19]

Hinchcliffe et al.

[11] Patent Number: 4,614,198

[45] Date of Patent: Sep. 30, 1986

[54] FILTER CIGARETTE MANUFACTURE

[75] Inventors: Dennis Hinchcliffe, London, England; Francis A. M. Labbe, Neuilly-sur-Seine, France

[73] Assignee: Molins, PLC, London, England

[21] Appl. No.: 613,629

[22] Filed: May 24, 1984

[30] Foreign Application Priority Data

May 25, 1983 [GB] United Kingdom ..... 8314509

[51] Int. Cl.[4] ..... A24C 5/47

[52] U.S. Cl. ..... 131/94; 131/88; 131/93

[58] Field of Search ..... 131/93, 94, 95, 88

[56] References Cited

U.S. PATENT DOCUMENTS

| | | | |
|---|---|---|---|
| 2,165,144 | 7/1934 | Lubbock | 131/95 |
| 2,714,384 | 8/1955 | Schubert | 131/95 |
| 3,363,632 | 1/1968 | Gamberini | 131/94 |
| 3,470,884 | 10/1969 | McArthur | 131/94 |
| 4,003,386 | 1/1977 | Bald et al. | 131/94 |
| 4,020,852 | 5/1977 | Baker | 131/94 |
| 4,433,694 | 2/1984 | Seragnoli | 131/95 |
| 4,445,519 | 5/1984 | Hinz et al. | 131/94 |

*Primary Examiner*—V. Millin
*Assistant Examiner*—H. Macey
*Attorney, Agent, or Firm*—Antonelli, Terry & Wands

[57] ABSTRACT

Oval filter cigarettes are made by forming rod groups each comprising at least one cigarette portion and at least one filter portion in axial alignment; placing each rod group on a wrapping member rotatably carried by a conveyor having a succession of such wrapping members, each group being provided with a portion of uniting paper overlapping the members of the group; and rotating each wrapping member with respect to the conveyor about an axis parallel to that of the rods so as to wrap the uniting paper of least partly around the corresponding rod group.

During rotation of each wrapping member the uniting paper may be gripped by suction ports to provide a tight wrap.

18 Claims, 8 Drawing Figures

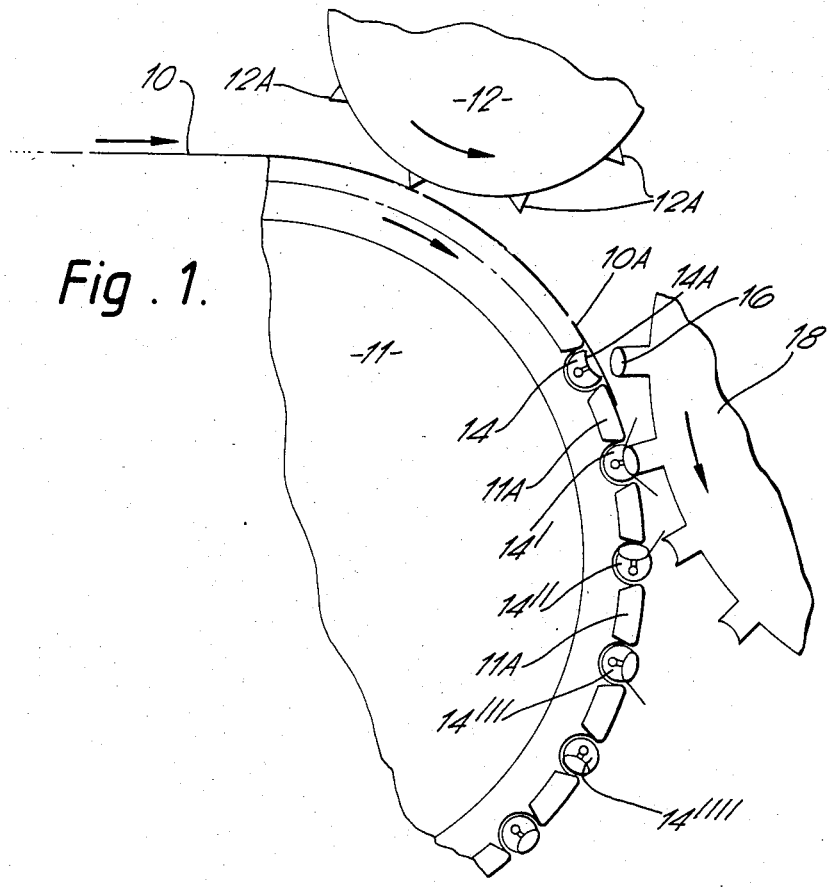
Fig . 1.
Fig . 2.
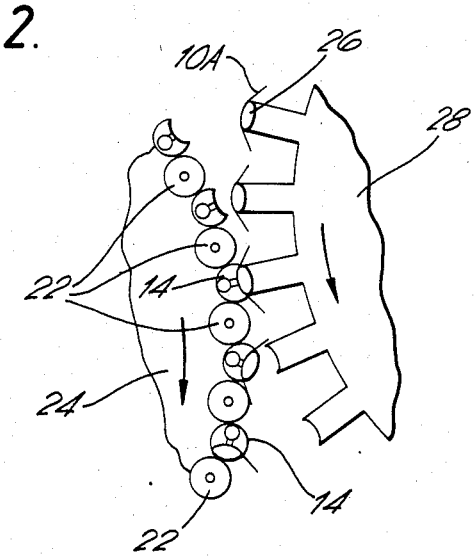

FILTER CIGARETTE MANUFACTURE

This invention is concerned with the manufacture of filter cigarettes of non-circular rounded cross-section. For convenience, such cross-sectional shapes will be referred to as "oval". In this context, however, the term "oval" is not intended to have its strict geometric meaning, but also includes other elongated rounded shapes; for example, it is intended to include a shape comprising two opposed sides of relatively large radius lying on opposite sides of what may be termed the "major axis", connected at their ends by smaller-radius curves.

According to one aspect of this invention, oval filter cigarettes are made by forming rod groups each comprising at least one cigarette portion and at least one filter portion in axial alignment; placing each rod group on a wrapping member rotatably carried by a conveyor having a succession of such wrapping members, each group being provided with a portion of tipping paper overlapping the members of the group; and rotating each wrapping member with respect to the conveyor about an axis parallel to that of the rods so as to wrap the tipping paper at least partly around the corresponding rod group.

In one preferred construction, the tipping paper is applied to each rod group while the latter is being carried by another conveyor which deposits the rod groups onto the wrapping members on the first-mentioned conveyor. Alternatively, each portion of tipping paper is fed onto one of the wrapping members before the corresponding rod group is transferred to the wrapping member. In both cases, the uniting paper lies between the wrapping member and the rod group. Rotation of the wrapping member in one direction causes a projecting portion of the tipping paper to be wrapped partly around the rod group, for example by contact with a fixed wiping member on the conveyor or with a freely rotatable roller on the conveyor. Complete wrapping of the tipping paper around each rod group may involve rotation of each wrapping member, through part of a revolution, first in one direction and then in the opposite direction; alternatively, the two edges of the tipping paper may be wrapped around the rod group while the latter is carried successively by rotatable members on different conveyors.

It is very desirable that the tipping paper should be tightly wrapped around the cigarette and filter portions so that it adheres around the entire peripheries of those portions and leaves no air leakage gap. For that purpose, in a preferred construction according to this invention, one or more suction passages are formed in a part along which the tipping paper slides while the corresponding rod group is being rotated to wrap the tipping paper around it, the effect of the suction being to grip the tipping paper and hold it in tension to ensure a tight wrap. The suction passages may all be formed in the conveyor carrying the rotatable members. Alternatively, at least one end of the tipping paper may be wrapped around the rod group as a consequence of being suctionally gripped by a member (e.g. a fixed shroud) separate from the conveyor carrying the rod group; during this wrapping operation the rod group may be rotated as a result of being carried by a wrapping member as described above.

According to another aspect of this invention, oval filter cigarettes of oval or other non-circular cross-section are made by forming rod groups each comprising at least one cigarette portion and at least one filter portion in axial alignment; placing each rod group on a conveyor together with a portion of tipping paper overlapping the members of the rod group and having at least one end projecting from the rod group, and wrapping the projecting end of the tipping paper at least partly around the rod group by means of suction gripping passages in a member along which the projecting end of the uniting paper is arranged to slide, whereby the suctional grip creates tension in the paper to cause the latter to be tightly wrapped around the rod group to join the filter portion to the cigarette portion. Wrapping may be effected by rotating each rod group with respect to the conveyor, for example in accordance with the first aspect of this invention; alternatively, the tipping paper may be engaged by a separate fixed or rotating member past which each rod group is carried by the conveyor.

In this context it will be understood that reference to an operation causing the tipping paper to be wrapped around the rod group does not necessarily mean that the wrapping is completed all the way around the rod group by that operation; instead, as will be made clear by the following description, the wrapping is normally completed by this invention in at least two operations.

Examples of filter cigarette manufacture according to this invention will now be described with reference to the accompanying drawings. In these drawings:

FIG. 1 is a diagrammatic illustration of part of one filter assembly machine;

FIG. 2 is a diagrammatic illustration of part of a second filter assembly machine;

Figure 3:
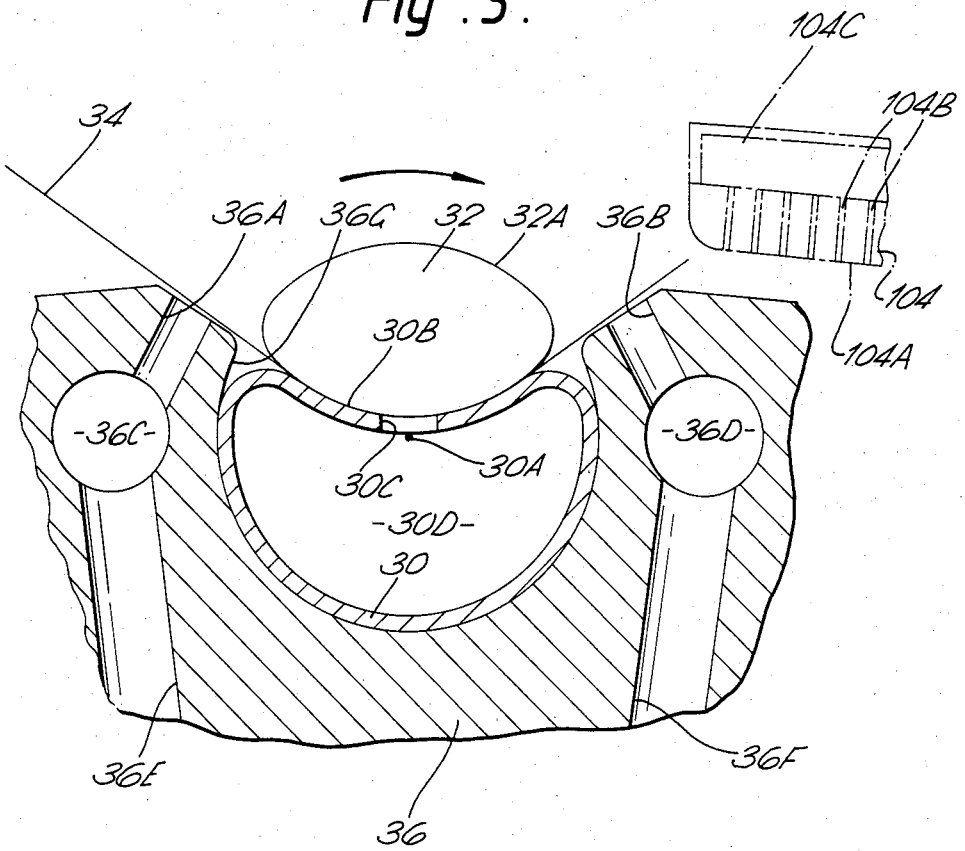
FIG. 3 is a cross-section on a larger scale of part of a third machine.

FIG. 1 shows a filter assembly machine in which a continuous web of tipping paper 10 coated with adhesive on its upper surface is fed tangentially towards a drum 11 on which the web is cut at regular intervals by a rotary cutting member 12 having a circumferentially spaced knives 12A. Each knife cuts the web in cooperation with a hardened insert 11A fitted in the periphery of the drum 11.

Between the inserts 11A the drum carries rotatably mounted wrapping members 14, 14', 14" etc. each having a suitably shaped flute 14A to receive an oval rod group 16 from a drum 18. Before receipt of a corresponding rod group 16, each portion 10A of the tipping paper is stretched across a wrapping member 14, being held on the conveyor drum 11 by suction ports (not shown) formed in the inserts 11A. The suction may be terminated by an internal sleeve valve (not shown) after a rod group has been pressed into the outwardly facing flute 14A of one of the members 14. Thus, as shown by the wrapping member 14', the ends of the tipping paper project outwards from the conveyor drum 11.

Figure 8:
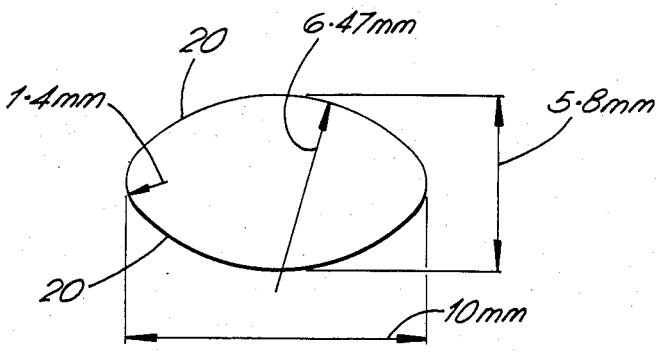
FIG. 8 is a cross-section on a large scale of an oval filter cigarette which may be assembled in accordance with this invention.

A preferred cross-section for the cigarette and filter portions is shown in FIG. 8. As shown therein, the length of the major axis is 10 mm, while the minor axis has a length of 5.8 mm. The main surfaces 20 on opposite sides of the major axis have a radius of curvature of 6.47 mm, the ends of those surfaces being joined by curves of 1.4 mm radius as shown.

With reference again to FIG. 1, each of the wrapping members 14 is rotated about an axis which coincides with the centre of curvature wof the outwardly facing main surface of the rod assembly. This is further explained with reference to FIG. 3.

After receipt of a rod group, each wrapping member 14 is rotated first in a counter clockwise direction with respect to the drum 11 by approximately 90° to wrap the projecting left end of the tipping paper around the rod group. Such rotation of each wrapping member in fact occurs gradually, but for the purposes of illustration the wrapping member 14'' is shown in FIG. 1 in its first fully rotated position. Each wrapping member 14 is then gradually returned to its starting position, as indicated by the member 14''', and is then rotated further through 90° in a clockwise direction (to the position shown by the member 14'''') so as to wrap the other projecting end of the uniting paper around the rod group. It will be understood that the extremities of the tipping paper overlap when they have been wrapped around the rod group so as to form a complete assembly.

After rotation to the position shown by the rotary member 14'''', each wrapping member is returned to its initial position to enable the assembled rod group to be transferred to a further conveyor (not shown).

During rotation of each wrapping member, each end in turn of the uniting paper may be ironed down firmly by contact with the adjacent side of one of the inserts 11A, which thereby acts as a wiping member and for that purpose may have a hardened and polished surface. An alternative is that the drum may carry a number of substantially radially extending leaf spring members having portions at their outer ends which resiliently engage the cooperating rod group while it is being rotated by the wrapping member, thus resiliently pressing the tipping paper onto the rod group. This would allow, for example, for any slight lack of centralisation of a rod group with respect to the corresponding wrapping member.

FIG. 2 shows a different construction. As an alternative to the fixed ironing members shown in FIG. 1, there are freely rotatable rollers 22 between the wrapping members, which are the same as in FIG. 1. The rollers 22 are mounted on a drum 24 which in this instance does not form part of the web cutting arrangement. Instead, the web of tipping paper is cut on a separate drum (not shown), each portion 10A then being picked up by a rod group 26 carried by a conveyor drum 28 which is similar to the drum 18 in FIG. 1. In this example, each wrapping member 14 rotates first in a clockwise direction with respect to the drum 24, thus causing the roller upstream of it to engage and iron down the upstream projecting end of the tipping paper. After returning to its starting position, each wrapping member rotates further in a counter-clockwise direction to iron down the other end of the tipping paper by engagement with the roller on its other side.

Figure 4:
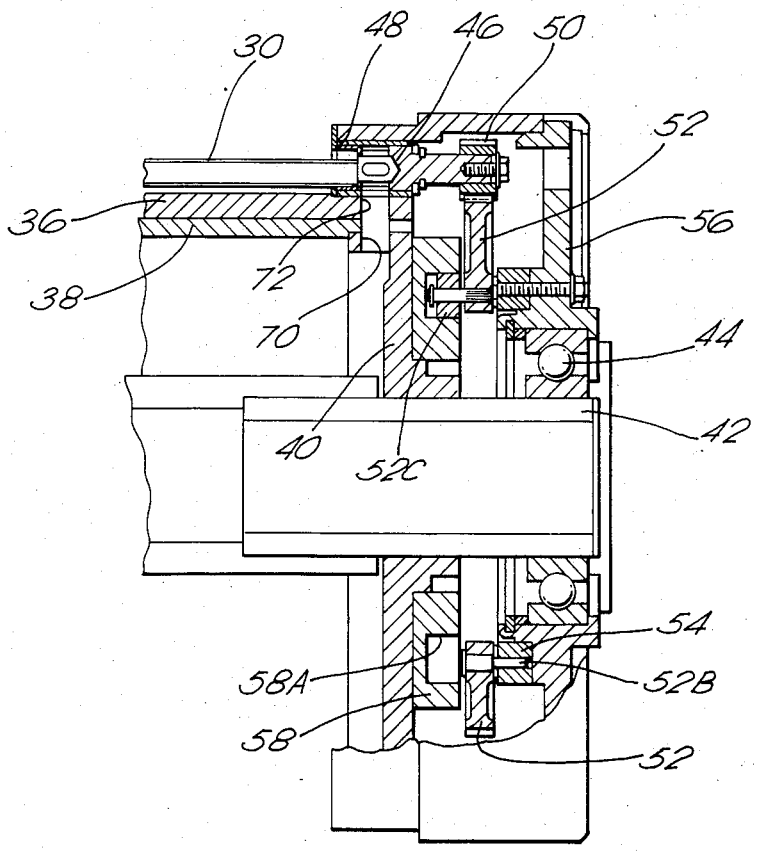
FIG. 4 is a longitudinal section of part of the drum, on a smaller scale, of the machine shown in FIG. 3.
Figure 5:
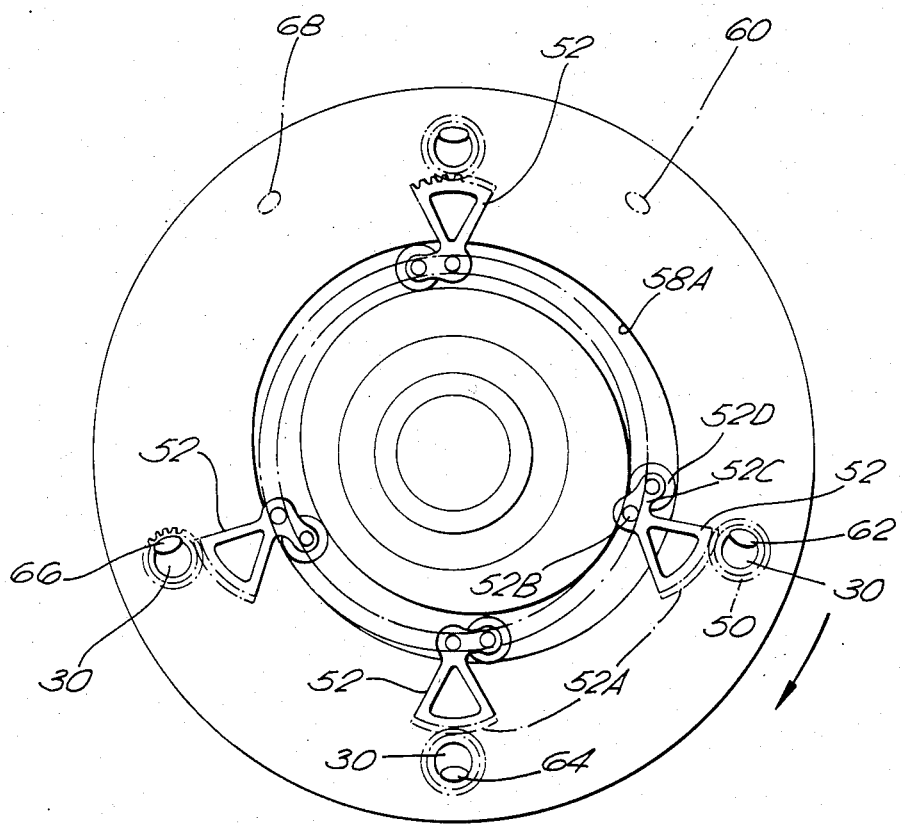
FIG. 5 is an end view illustrating the mechanism in the drum of FIG. 4 whereby the wrapping members carrying the rod groups are rotated.

FIGS. 3 to 5 show a different arrangement including details regarding the specific construction of each wrapping member and the means whereby it is rotated. In this context it should be noted that each rod group preferably comprises two cigarette portions and an interposed double filter portion. After assembly, as with conventional cigarettes, each rod group is cut through the middle to produce two filter cigarettes.

As shown in FIG. 3, each wrapping member 30 is arranged to rotate about an axis 30A which coincides with the centre of curvature of the outer surface 32A of a rod group 32 carried in a concave recess 30B formed in the wrapping member. The wrapping member is hollow, its interior space 30D being in communication with a source of suction when necessary (as described below) so that suction applied through a number of ports 30C holds the cigarette portions of the rod group 32 firmly in position; the double filter portion between the cigarette portions is held on the wrapping member by the adhesive on the tipping paper and by engagement with the abutting ends of the cigarette portions.

In order to wrap the tipping paper 34 tightly around the rod group 32, the drum 36 is formed with rows of suction ports 36A and 36B communicating respectively with manifolds 36C and 36D which in turn lead via radial passages 36E and 36F to a central source of suction, admission of suction to the passages being controlled by a sleeve valve (not shown) within the drum.

When the wrapping member 30 is rotated in a counter-clockwise direction with respect to the drum 36, the part of the paper 34 extending to the left of the rod group is gripped by the suction transmitted through the passages 36A so as to maintain the paper in tension and thus ensure that it is tightly wrapped around the rod group. During the final stage of the rotation of the member 30, the end of the paper is ironed down by a part 36G of the recess in the drum 36 which contains the wrapping member. To ensure that the paper is not peeled back as the wrapping member returns to its starting position, the drum 36 may include a source of compressed air leading to narrow passages extending radially towards the axis 30A of the wrapping member from the surface 36G and from the downward extension thereof to produce a form of air bearing.

Rotation of the wrapping member 30 in a clockwise direction from the position shown in FIG. 3 will similarly cause the right-hand of the uniting paper to be wrapped tightly around the rod group as a result of suction applied through the passages 36B.

FIGS. 4 and 5 show how the wrapping members are rotated to achieve the operation described above. FIG. 4 shows one of a number of wrapping members 30 carried by a drum 36 which rotates around a fixed valve sleeve 38 secured via a flange 40 to a fixed centre member 42. A bearing 44 at one end of the drum (there being another at the other end) supports the drum for rotation around the fixed member 42.

The wrapping member 30 is rotatably supported at each end by a trunnion 46 rotatable in a bearing sleeve 48. At the end of the drum shown in FIG. 4, the trunnion carries a gear 50 which meshes with a segment gear 52A formed around the outer extremity of a member 52 pivotally mounted by a pin 52B on a ring 54 secured to an end portion 56 of the drum. Each member 52 is somewhat like a bell crack in that is has a lateral projection 52C carrying a roller 52D serving as a follower engaging in a cam track 58A in a fixed annular member 58.

As shown in FIG. 5, the distance of the cam track from the axis of the drum varies at different circumferential positions so as to rotate each member 52 about its pivot pin 52B during rotation of the drum. Rotation of the member 52 in turn rotates the gear 50 on the trunnion 46 and consequently rotates the wrapping member 30 in the appropriate direction. By way of example, the cam track shown in FIG. 5 is such that a rod group placed on a wrapping member at the position shown by the outline 60 is rotated first in a counter clockwise direction to the position occupied by the rod group 62; then the cam track returns the rod group to its original position, as shown by the rod group 64; clockwise rotation of the rod group with respect to the drum then continues to the position shown by the rod group 66; and the rod group is then returned to its original orientation in time to be transferred from the drum to a further drum at the position 68.

Suction is transmitted to the interior of each end of each wrapping member, when necessary, via a slot 70 in the fixed valve sleeve 38 which communicates with a radial 72 leading permanently via a suitably shaped passage in the trunnion 46 to the interior of the wrapping member 30. The arrangement is such that suction continues to be applied while the wrapping member is rotating with respect to the drum, and terminates when the rod group is to be transferred to the next drum.

Figure 6:
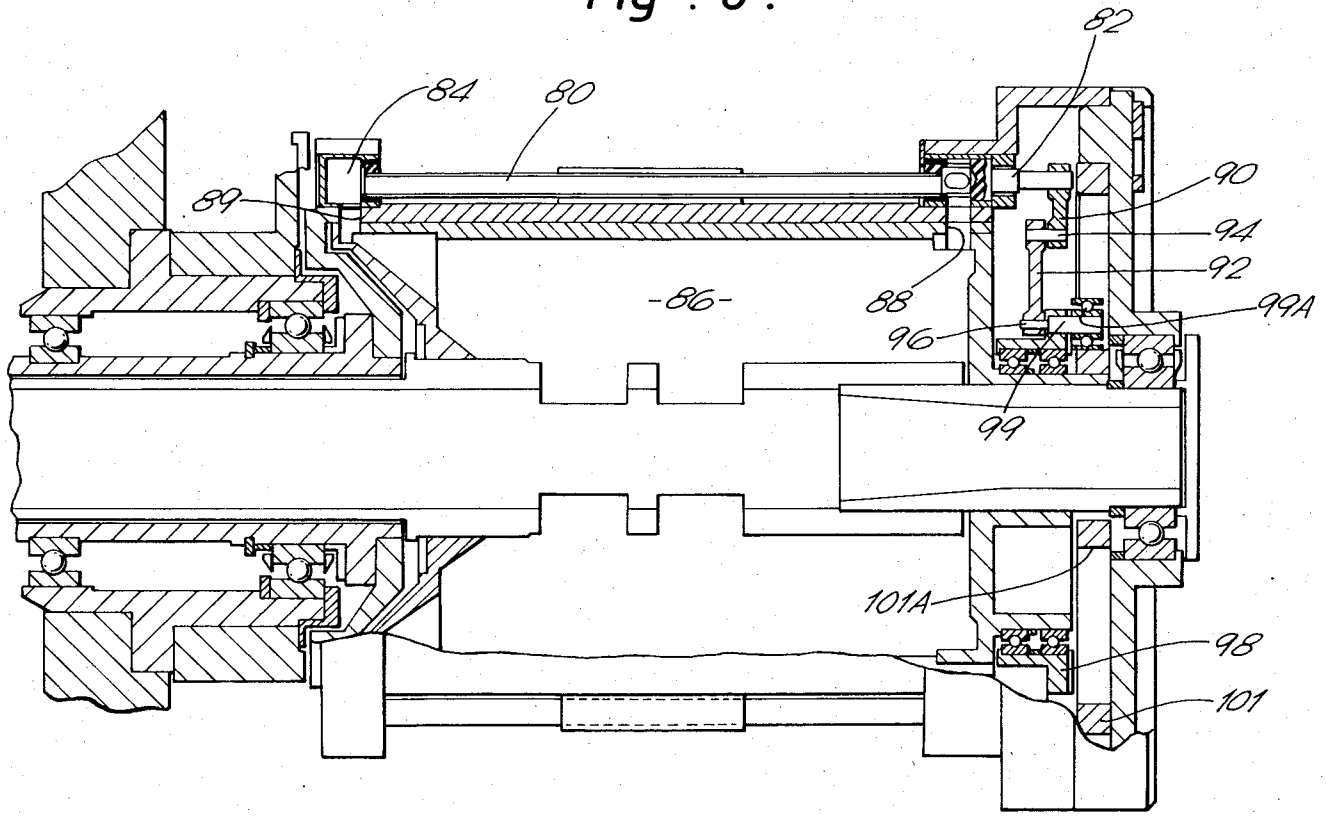
FIG. 6 is a modification of the drum shown in FIG. 4.
Figure 7:
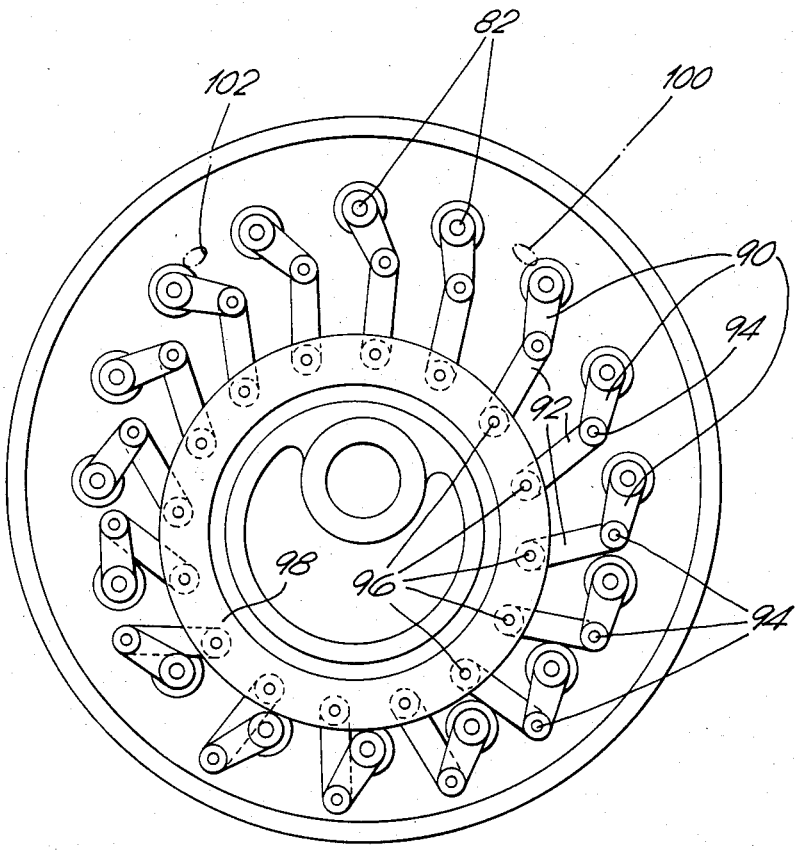
FIG. 7 is a diagrammatic end view of the drum shown in FIG. 6.

FIGS. 6 and 7 show a different drum in which a different arrangement is employed for rotating the wrapping members. FIG. 6 shows a complete longitudinal section of the drum and shows in particular one wrapping member 80 which is rotatably mounted by means of a trunnion 82 at its right-hand end and by a non-driven part 84 at its other end. As in FIG. 4, suction from a space 86 is transmitted, when necessary, to the interior of each wrapping member via a slot 88 at the right-hand end and via a somewhat different but equivalent arrangement 89 at the left-hand end.

In this example, each trunnion 82 carries an arm 90 which is pivoted at its far end to a link 92 by a pin 94, the other end of each link 92 being pivoted by a pin 96 to a rotating annular member 98 which is eccentric with respect to the drum.

The annular member 98 is driven at the same speed as the drum. For that purpose five circumferentially spaced pins 99 on the annular member 98 project into corresponding circular apertures 101A in a member 101 which is secured to and coaxial with the drum. The pins 99 are surrounded by ball or roller bearings 99A which roll around the inner walls of the apertures 101A as the members 98 and 101 rotate about their respective axes, thereby enabling the member 101 to drive the member 99.

Because of the eccentricity of the member 98 with respect to the drum, each of the trunnions 82 is rotated in a counter-clockwise direction with respect to the drum through nearly 120° and then back to its starting position. Consequently a rod group delivered to the drum at the position 100 is rotated in the manner described, reaching its maximum rotation approximately at the bottom of the drum, and is then returned to its original orientation ready to be transferred to the next drum at the position 102.

This mode of rotation of each wrapping member is used in the following way. With reference to FIG. 3, the part of each portion of tipping paper projecting to the left is wrapped over the top of the rod group in the manner previously described. However, instead of the suction passages 36D being used to wrap the other end of the uniting paper over the rod group, there is a fixed shroud which is shown in ghost outline in FIG. 3. This shroud 104 extends around the drum approximately from the bottom of the drum to a position immediately upstream of the transfer position 102. An inner face 104A of the shroud is set at a fixed distance from the periphery of the drum such as to be slightly clear of the outer surface of the rod group. Moreover, the shroud has suction passages 104B through which suction is applied from a manifold 104C. Consequently, as the rod group rotates with respect to the drum while moving past the shroud, suction applied through the passages 104B in the shroud cause the uniting paper to be gripped by the shroud so as to wrap the paper tightly around the rod group as the latter rotates with respect to the drum. Because the shroud preferably does not actually make contact with the rod group, the last portion of the tipping paper is not actually ironed down; however, when the rod group is transferred to the next drum, the lap formed by the tipping paper is pressed down by virtue of the fact that it lies against the surface of the flute of that next drum.

Instead of being at a constant distance from the drum 36, the start of the shroud 104 (i.e. the left-hand end) may be closer to the drum so as the begin to grip the tipping paper earlier. For that purpose, each wrapping member would need to be recessed where necessary to provide clearance for the shroud.

It is important in general to ensure that each filter portion is axially aligned with the associated cigarette portion or portions to which it is to be joined. That may be ensured by arranging for one of the drum-to-drum transfers of filter portions (possibly together with the cigarette portions) to take place as follows: the flutes of the two drums at the transfer position fit closely around the filter portions (possibly even producing slight compression of the filter portions) to define precisely the orientation of the filter portions and hence the positions of their axes; the filters are released from holding suction immediately before the transfer to allow them to move slightly if necessary, and are firmly gripped automatically by the receiving drum immediately after the transfer.

We claim:

1. A method of making oval filter cigarettes comprising the steps of forming rod groups each comprising at least one cigarette portion and at least one filter portion in axial alignment; placing each rod group on a wrapping member rotatably carried by a conveyor having a succession of such wrapping members, each group being provided with a portion of tipping paper overlapping the members of the group; and rotating each wrapping member with respect to the conveyor about an axis parallel to and spaced from that of the rods to thereby carry said rod group bodily about said axis so as to wrap the tipping paper at least partly around the corresponding rod group.

2. A method according to claim 1 in which the tipping paper is applied to each rod group while the latter is being carried by another conveyor which deposits the rod groups onto the wrapping members on the first-mentioned conveyor.

3. A method according to claim 1 in which each portion of tipping paper is fed onto one of the wrapping members before the corresponding rod group is transferred to the wrapping member.

4. A method according to claim 1, 2 or 3 in which wrapping of each portion of tipping paper around the corresponding rod group is effected by engagement of the tipping paper with a wiping member during rotation of the wrapping member.

5. A method of making oval filter cigarettes comprising the steps of forming rod groups each comprising at least one cigarette portion and at least one filter portion in axial alignment; placing each rod group on a conveyor together with a portion of tipping paper overlapping the members of the rod group and having at least one end projecting from the rod group, moving said rod group bodily about an axis parallel to and spaced from that of said rods, and wrapping the projecting end of the tipping paper at least partly around the rod group by engaging the tipping paper with a member having suction gripping passages and along which the projecting end of the tipping paper is arranged to slide, whereby the suctional grip creates tension in the paper to cause the latter to be tightly wrapped around the rod group to join the filter portion to the cigarette portion.

6. A machine for assembling oval filter cigarettes comprising means for forming rod groups each comprising at least one cigarette portion and at least one filter portion in axial alignment, a conveyor having rotatably mounted thereon a plurality of similar wrapping members, means for feeding portions of adhesive-coated tipping paper and rod groups successively onto the wrapping members such that each rod group is provided with a portion of tipping paper overlapping the components of the group for adhesion thereto, and means for rotating each wrapping member with respect to the conveyor about an axis parallel to and spaced from that of the rods so as to carry said rod group bodily about said axis for wrapping the tipping paper at least partly around the rod group.

7. A machine according to claim 6 in which the tipping paper is applied to each rod group while the latter is being carried by another conveyor which deposits the rod groups onto the wrapping members on the first-mentioned conveyor.

8. A machine according to claim 6 in which each portion of tipping paper is fed onto one of the wrapping members before the corresponding rod group is transferred to the wrapping member.

9. A machine according to claim 6, 7 or 8 including a wiping member which is arranged to engage the tipping paper during rotation of the wrapping member to wrap the tipping paper around the rod group.

10. A machine according to claim 9 in which the wiping member is fixed, being mounted adjacent to the conveyor.

11. A machine according to claim 10 in which the or each wiping member is formed with passages communicating with a source of suction for gripping the tipping paper and for thereby placing it in tension while wrapping it around the corresponding rod group.

12. A machine according to claim 9 in which a separate wiping member for each wrapping member forms part of or is attached to the conveyor.

13. A machine according to claim 12 in which the or each wiping member is formed with passages communicating with a source of suction for gripping the tipping paper and for thereby placing it in tension while wrapping it around the corresponding rod group.

14. A machine according to claim 6 in which the means for rotating each wrapping member comprises cam means cooperating with follower means connecting to or carried by the wrapping members.

15. A machine for assembling oval filter cigarettes comprising means for forming rod groups each comprising at least one cigarette portion and at least one filter portion in axial alignment, a conveyor having rotatably mounted thereon a plurality of similar wrapping members, means for feeding portions of adhesive-coated tipping paper and rod groups successively onto the wrapping members such that each rod group is provided with a portion of tipping paper overlapping the components of the group for adhesion thereto, and means for rotating each wrapping member with respect to the conveyor about an axis parallel to that of the rods for wrapping the tipping paper at least partly around the rod group, in which the means for rotating the wrapping members comprises links pivotally connected to a rotary member eccentric to the conveyor.

16. A machine for assembling oval cigarettes comprising means for forming rod groups each comprising at least one cigarette portion and at least one filter portion in axial alignment; means for delivering each rod group onto a conveyor together with a portion of tipping paper overlapping the members of the rod group and having at least one end projecting from the rod group, and means for moving said rod group bodily about an axis parallel to and spaced from that of said rods and for wrapping the projecting end of the tipping paper at least partly around the rod group by engaging the tipping paper with a member having suction gripping passages and along which the projecting end of the tipping paper is arranged to slide, whereby the suctional grip creates tension in the paper to cause the latter to be tightly wrapped around the rod group to join the filter portion to the cigarette portion.

17. A method of making oval filter cigarettes comprising the steps of forming rod groups each comprising at least one cigarette portion and at least one filter portion in axial alignment; placing each rod group on a wrapping member rotatably carried by a conveyor having a succession of such wrapping members, each group being provided with a portion of tipping paper overlapping the members of the group; and rotating each wrapping member with respect to the conveyor so as to wrap the tipping paper at least partly around the corresponding rod group, said rotation being in both a counterclockwise and a clockwise direction at different periods during the wrapping of the rod group.

18. A machine for assembling oval filter cigarettes comprising means for forming rod groups each comprising at least one cigarette portion and at least one filter portion in axial alignment, a conveyor having rotatably mounted thereon a plurality of similar wrapping members, means for feeding portions of adhesive-coated tipping paper and rod groups successively onto the wrapping members such that each rod group is provided with a portion of tipping paper overlapping the components of the group for adhesion thereto, and means for rotating each wrapping member with respect to the conveyor for wrapping the tipping paper at least partly around the rod group, said rotation being in both a counterclockwise and a clockwise direction at different periods during the wrapping of the rod group.

* * * * *